United States Patent [19]

Campion et al.

[11] Patent Number: 4,876,783

[45] Date of Patent: Oct. 31, 1989

[54] METHOD AND APPARATUS FOR CONVERSION OF DOORKNOB LOCK SETS

[75] Inventors: Neil P. Campion, Edina; Michael J. Foty, Bloomington; Richard P. Novak, Minneapolis, all of Minn.

[73] Assignee: Progressive Security Products, Inc., Edina, Minn.

[21] Appl. No.: 64,805

[22] Filed: Jun. 19, 1987

[51] Int. Cl.[4] ..... E05B 15/00

[52] U.S. Cl. ..... 29/401.1; 29/402.03; 29/402.08; 70/224

[58] Field of Search ..... 29/401.1, 402.1, 402.03, 29/402.08; 70/224, 216, 479, 368, 476, 215, 372, 379, 466, DIG. 39

[56] References Cited

U.S. PATENT DOCUMENTS

| | | |
|---|---|---|
| 2,007,350 | 7/1935 | Schlage . |
| 2,079,583 | 5/1937 | Brauning . |
| 2,683,367 | 7/1954 | Hillgren . |
| 3,354,676 | 11/1967 | Wilson . |
| 4,435,967 | 3/1984 | Best et al. . |
| 4,444,034 | 4/1984 | Best et al. . |

OTHER PUBLICATIONS

Falcon Lock Brochure, p. 13, and Notice No. 210 (Rev. A).
Best Lock Corporation Brochure, Catalog Section 6.
Russwin Brochure entitled "No. 640 Entrance and Office Lock and No. 3640 Fire Door Lock".
E. L. Reinhardt Co. Brochure entitled "Arrow 28".
Best Lock Corporation Brochures entitled "5K and 57K Series"; 77K Cylindrical Lockset Specifications; 8-K-C4 Function; 8-K-AB4 Function; Cylindrical Locks-Heavy Duty.
Corbin Brochure entitled "No. 351 Entrance and Office Lock".
Corbin Brochure entitled "Section B/Heavy Duty Cylindrical Locksets".
Russwin Brochure entitled "Architectural Doorware"; Form No. AC 1-81.
P. & F. Corbin Brochure entitled "Unit Locksets 300 Series"; Form No. C300-75.
Russwin Brochure entitled "'Forum' Cylindrical Locksets".
Russwin Brochure entitled "'Executive' Residential Locksets".
Russwin Brochure entitled "Heavy Duty 'Uniloc' Locksets".
Russwin Brochure entitled "Parts List 'Stilemaker' Heavy Duty Cylindrical Locksets Model 68".
Dominion Lock brochure entitled "Heavy Duty Cylindrical Lockset".
Falcon Brochure entitled "Interchangeable Cores and Locks with Provisions to Accept Interchangeable Cores"; Form No. 0205.
Collection of Falcon Materials.
Lloyd Matheson, Inc. Brochures entitled "300 Series Heavy Duty Cylindrical Locks".
Sargent & Company Brochures.
Schlage Brochures.
Schlage Brochure entitled "D Series Locks Heavy Duty Line-Technical Manual".
Yale Brochures.

*Primary Examiner*—Joseph M. Gorski
*Attorney, Agent, or Firm*—Merchant, Gould, Smith, Edell, Welter & Schmidt

[57] ABSTRACT

A method of converting a conventional lock set from one manufacturer's lock cylinder to another's is provided. The method includes provision of a universal doorknob or handle mountable, generally by means of adaptors, on any of a variety of manufactures of hardware systems. The universal knob includes means therein for mounting of a selected manufacture or design of lock cylinder. According to the method a tail piece member is provided, to translate motion from the lock cylinder to a drive mechanism of the hardware system being converted. Generally, according to the method each different design of lock cylinder will have a different universal knob design associated therewith. Further, each selected lock cylinder design will have associated therewith a set of tail piece members, one for each manufacture or design of hardware systems. As a result of the above, almost any type of hardware system can be readily converted to a system utilizing a universal knob and a selected lock cylinder.

21 Claims, 3 Drawing Sheets

FIG. 1
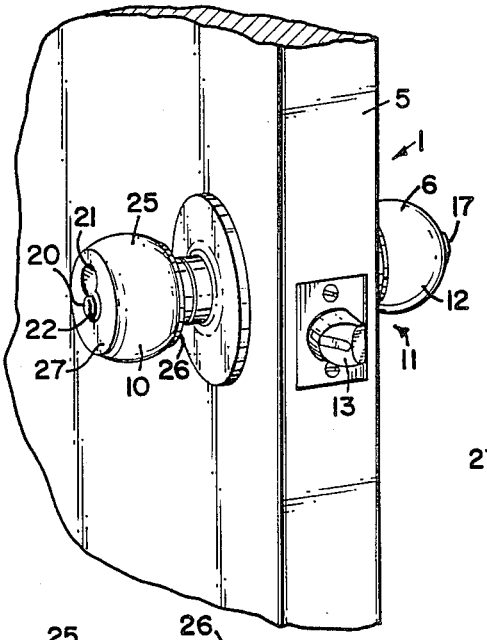
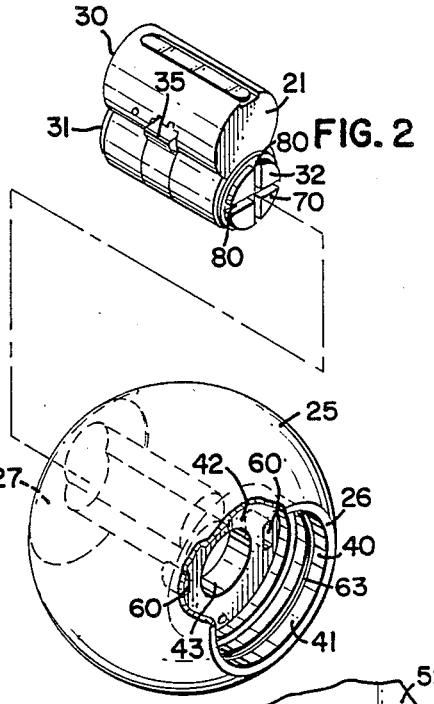
FIG. 2
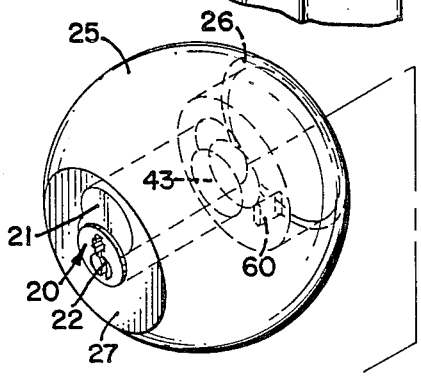
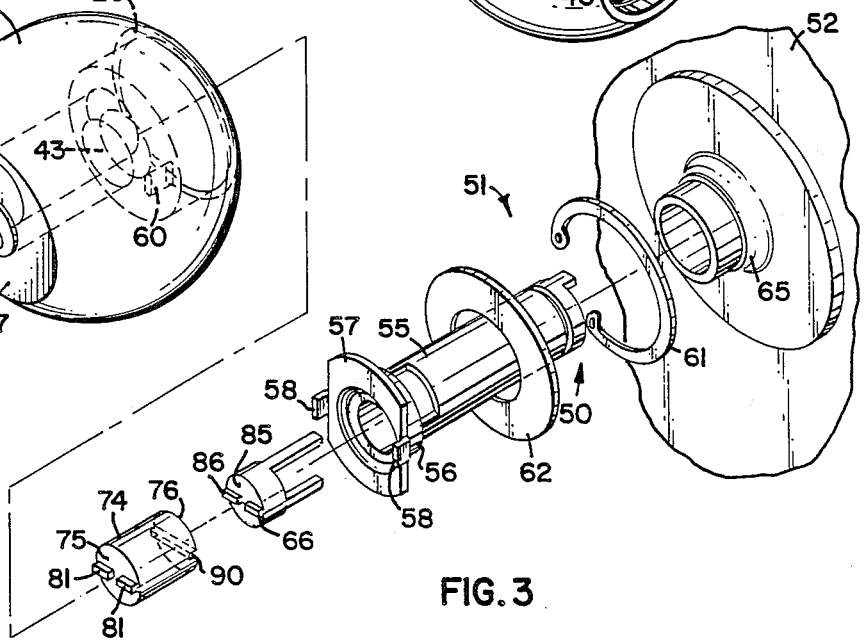
FIG. 3

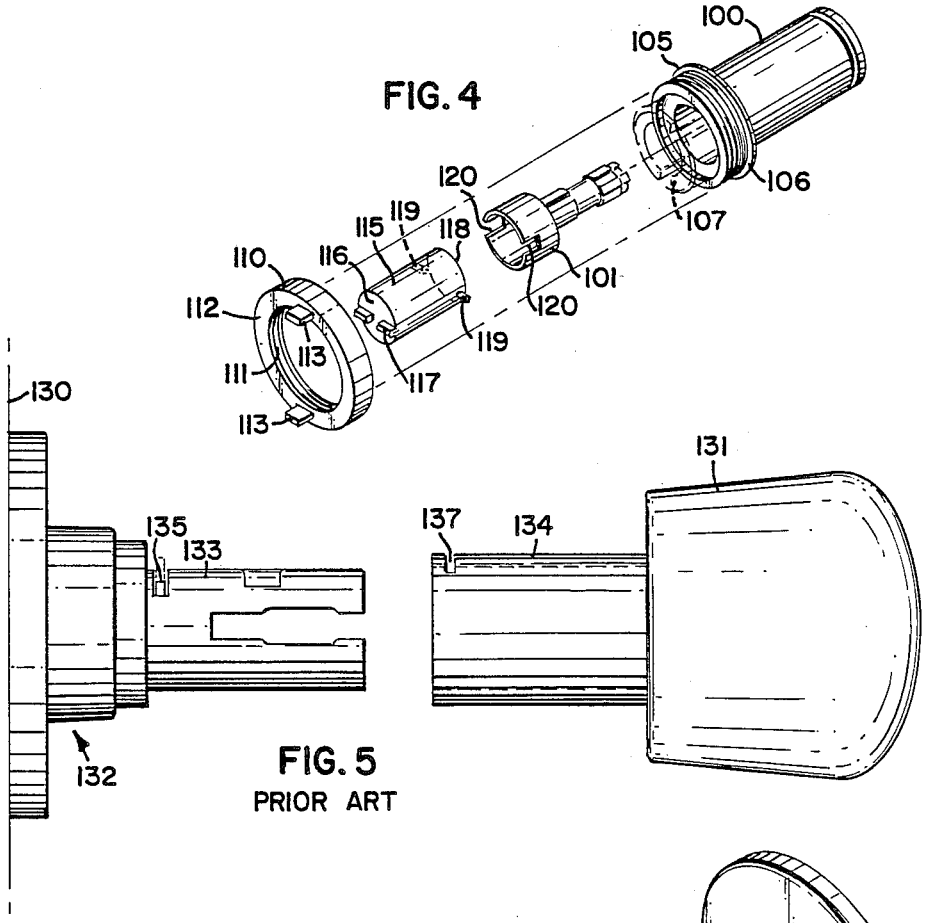
FIG. 4
FIG. 5
PRIOR ART
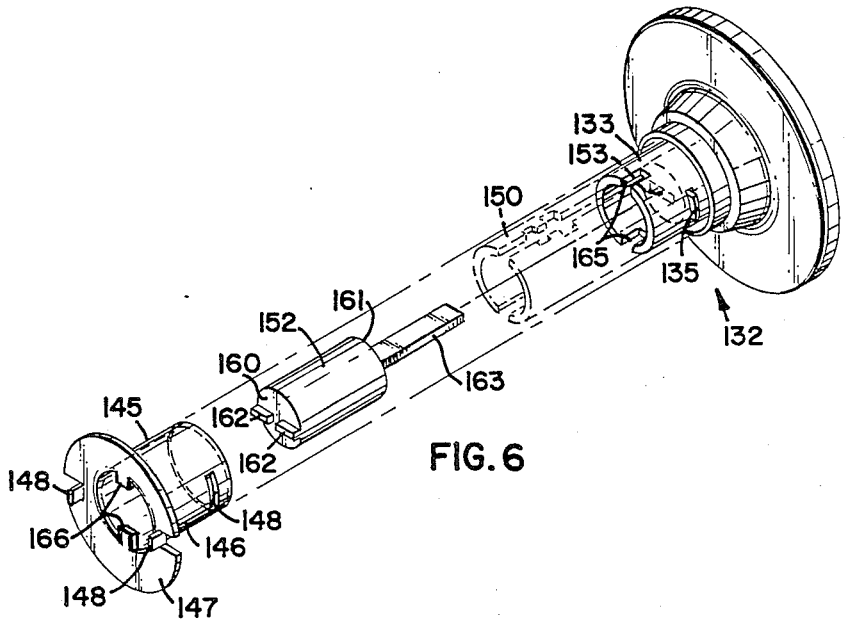
FIG. 6

METHOD AND APPARATUS FOR CONVERSION OF DOORKNOB LOCK SETS

FIELD OF THE INVENTION

The present invention relates to locks, and particular to key-in-knob/handle lock sets. The invention particularly concerns key-in-knob/handle lock sets having interchangeable lock cores or otherwise removable cylinders therein and conversion of conventional hardware, without interchangeable lock cores, to such an arrangement having a desired cylinder style.

BACKGROUND OF THE INVENTION

Numerous types of key-in-knob/handle lock arrangements have been developed. Generally all such arrangements are characterized by having a latch bolt operable by an outside door handle or cylinder. A lock mechanism of such systems can be set in a manner preventing rotation of the outer knob or handle to retract the latch bolt. Typically, the outer knob or handle is mounted upon a spindle arrangement. The lock spindle or spindle arrangement provides for translation of the rotational motion of the outside knob to operation of the latch bolt mechanism. The lock mechanism is typically used to prevent rotation of the spindle and the outer knob.

In many conventional systems an inner doorknob of the arrangement includes a centrally positioned button or knob thereon which can be selectively set in a position causing prevention of rotation of the outer knob and spindle. In such systems, the outer knob may include a lock cylinder therein which, when operated by a key, translates motion into the internal hardware, to free the spindle for rotation and/or retract the latch bolt. Generally, the key-in-knob/handle lock set hardware, internally, includes a driver engaged by an extension of the lock cylinder. As the lock cylinder is rotated, the driver or driver mechanism is engaged and rotated, unlocking the door or retracting the latch bolt. In those systems which utilize a button on the inside knob for locking, rotation of the driver generally generates a dislodging of the locking button from its locked position.

A wide variety of types of lock cylinders or cylinder arrangements have been utilized in key-in-knob/handle locksets. In many instances a preferred cylinder is one which can be readily removed and replaced. Generally such cylinders are termed interchangeable core cylinders and many include a projection thereon which is oriented to engage a receiving space within the knob, to retain the cylinder in position. The extension is selectively extendable and retractable, to be received within the knob receiving space. Operation of the extension is generally conducted by means of a control key that can be inserted in a cylinder arrangement to operate the extension, without operating the lock mechanism.

In other systems, the lock cylinder is not readily removable and replaceable, by means of a control key. Rather, for such systems substantial disassembly of the lock, often including disassembly of the internal lock hardware, may be necessary for removal and replacement of the cylinder itself.

Key-in-knob/handle lock sets, including conventional doorknob systems, are used in a variety of applications including office buildings, college or university campuses, airports, hospitals, schools, apartment complexes, museums and in similar institutions. Very often in such facilities many or all of the key-in-knob/handle lock sets are keyed to a single master key. That is, a single master key can be used to obtain passage through any door on that master key system. Such systems are well known and very convenient.

For security reasons it is often desireable to change all of the lock cylinders in a master key system. This may be done, for example, to prevent loss of security as keys are lost or as employees leave with keys or copies of keys. Also, it may be desireable to re-key systems periodically just as a precaution or to update a system. In most key-in-knob/handle lock sets this is possible, however in some it is more easily accomplished than in others. In systems having interchangeable core locks operable by a master key, changing lock sets can be relatively easy, provided the lock cylinder is changed to one appropriately designed for engaging the existing lock and knob. This, generally, has required replacement with a lock cylinder of the same or similar manufacture as the one originally removed.

In other systems, changing lock cylinders is considerably more difficult. For example, substantial disassembly of the hardware may be necessary, which leads to a substantial cost and usually requires the services of a locksmith. Further, in the past the lock cylinder for such arrangements had to be replaced with a cylinder of the same or similar manufacture.

In general, in the past it has not been readily possible to convert a key-in-knob/handle lock set from one manufacture or style of lock cylinder, to another. This has been generally true regardless of the manufacture and nature of the key-in-knob/handle lock set. In arrangements having interchangeable core locks, since interchangeable core locks of various manufacturers are not made to universal standards one lock core generally could not be readily replaced with one of another's manufacture. For systems without interchangeable core locks, the problem has been analogous.

At least one system has been proposed for conversions. This system involves the production of a special adaptor knob to replace the outer knob of a particular model or design of doorknob. The adaptor knob includes means for receiving an interchangeable core, different from that in the original knob. An adaptor is provided to permit mechanical communication between the new knob and the old hardware. The system is impractical, in part, because each design of lock set requires a specially designed custom replacement knob, thus making conversion impractical unless done on a very large scale.

In the past, impractical convertability has posed substantial problems. For example, if an office building or institution is fitted with dozens, or perhaps hundreds, of lock sets without readily interchangeable cores, obtaining interchangeable cores or improvement in lock cylinder quality has been an expensive proposition. This generally results since conversion often requires disassembly of each and every lock set and in many instances a complete replacement of the hardware.

Even in lock systems with interchangeable cores there have been problems. For example, if the manufacturer of a particular design of interchangeable core cylinder goes out of business, there may not be a ready source of replacement cores. Further, an improvement in lock core quality, by means of obtaining a different core of different design from a different manufacturer, is not readily available since it would not fit the existing knob. Again, manufacturing a custom knob or handle for each and every design of lock set is an expensive process.

What has been needed has been a method and apparatus system for converting a lock set to an arrangement having a universal key-in-knob/handle. For systems that do not have interchangeable cores, this can be used to achieve desired interchangeability. By "universal knob/handle" it is meant that the knob/handle is such that it can be mounted on substantially any lock set. The universal knob/handle would be, however, typically designed for the mounting of only one style or design of lock cylinder therein. To convert cylinder type the universal knob is such that it can be removed and replaced by a different universal knob appropriately adapted for receipt of a lock cylinder of a different manufacture or design. Thus, what has been needed and is provided is a system of universal knobs each of which is appropriately adapted for mounting on a variety of hardware systems, and each of which is appropriate for receipt of a particular style, design or manufacture of lock cylinder. As a result of this system, substantially any key-in-knob/handle hardware set of any manufacturer could be efficiently converted to an arrangement utilizing a lock cylinder of any manufacture.

OBJECTS OF THE INVENTION

Therefore, the objects of the present invention are: to provide a universal knob adapted for mounting in association with a hardware system of a variety of types or designs of manufacture; to provide a method of mounting a universal knob in association with hardware sets of various designs of manufactures; to provide such a method adapted for application to hardware sets wherein a key operated knob of the lock set, prior to conversion, is of either a male or a female design; to provide a preferred such universal knob adapted for receipt of a selected cylinder type of design therein; to provide such a method which includes provision of a tail piece member to translate motion from an associated lock core to a drive mechanism of an associated hardware set; to provide such a method wherein the mounting of the universal knob on a conventional hardware set may selectively include providing an adaptor to accommodate such mounting; to provide an adaptor for use in association with such a method; to provide a preferred such adaptor applicable for use with a variety of conventional hardware sets; to provide a method whereby a variety of hardware sets can be readily and fairly inexpensively converted to a system having such a universal knob/handle; to provide such a method which is relatively inexpensive to implement and easy to effect; to provide preferred equipment for use in application of such a method which is relatively simple to manufacture, easy to use and particularly well adapted for the proposed usages thereof. Other objects and advantages of this invention will become apparent from the following descriptions, taken in connection with the accompanying drawings wherein are set forth by way of illustration and example certain embodiments of the present invention.

SUMMARY OF THE INVENTION

The present invention comprises a method of converting a conventional lock set to one having a universal knob/handle thereon. The term "universal knob/-handle" as used herein generally refers to a key-in-knob arrangement or handle adapted for receipt of a lock core therein and further adapted for mounting in association with hardware sets of a variety of manufacture. In the past, key operated knobs have not been ID universal. That is, generally each key-in-knob arrangement or handle could only be mounted on a hardware set of the same design and manufacture. The inability to interchange parts generally inhibited ability to change lock cores and has resulted in increased costs in conversions among or between systems; sometimes with a complete replacement of hardware being required.

According to the present invention a variety of universal knobs (i.e. handles) can be provided, each specifically or specially adapted to receive a particular type or style of lock core or lock cylinder arrangement therein. As a result, through the provision of a universal knob for each manufacturer's lock cylinder, substantially any hardware assembly of any manufacture can be converted or adapted such that the key operated knob or knobs will operate by means of a lock cylinder assembly of any style or manufacture. This will become more apparent from the detailed description below. An advantage is that relatively few designs of universal knobs will be needed, basically one for each design of lock cylinder. Thus, when one universal knob is replaced by another, in converting to a different lock cylinder, the used universal knob may still be used in almost any lock set converted to the lock cylinder for which that used knob was designed.

In general application, the method according to the present invention takes on different specific features, depending upon the nature of the hardware being converted. Generally conventional hardware sets can be characterized as two basic types, those in which the key operated knob is a female-type and those in which the key operated knob is a male-type.

Female knobs or handles have an outer surface which faces outwardly from the door, and generally includes a key slot therein for operating the lock, and an inner face which faces the door. The inner face includes a recess therein. Such a female doorknob or handle is generally mounted upon a hardware system through receipt of a portion of the spindle arrangement of the hardware system into the recess on the inner face of the knob. Engagement between the knob and the spindle has been by a variety of systems, depending upon the manufacture of the hardware. Examples of female knob arrangements are: Corbin heavy duty cylindrical lock sets, produced by P & F Corbin, Hardware Division, Emhart Industries, Inc., Berlin, Conn. 06037; and, the Sargent models 2U05, 2G05 and 2G63 lock sets, available from Sargent & Company, New Haven, Conn. 06511.

In the Corbin type system, the key operated doorknob is directly mounted on an outer portion of the spindle. The outer portion of the Corbin spindle comprises a flange having a pair of ears or tangs thereon which are received within recesses in a portion of the knob. The knob is retained upon the flange by means of a snap ring or similar arrangement.

For the Sargent arrangement, the doorknob is threaded upon a flange on the spindle assembly. The spindle assembly is then mounted within a portion of the hardware, to translate motion from the knob to the latch bolt.

Conversion of a lock set having a female-type knob, such as the Corbin and Sargent lock set systems, to a system having a universal knob according to the present invention will generally require: replacement of an outer knob of the assembly; replacement of a lock core of the assembly; and introduction into the assembly of a tailpiece member. In general, the operation follows from selection of a desired manufacture of lock cylinder. An appropriate universal knob for that cylinder is provided. The existing knob on the hardware set is removed and replaced by the universal knob. In most instances it is necessary to provide an adaptor member, to facilitate engagement between the universal knob and the conventional lock spindle. For example, for a Sargent system such an adaptor is generally necessary.

To complete a conversion to a universal knob according to the present invention, it is necessary to provide a tail piece member. The tail piece member, as will be more fully understood from the detailed description, provides for translation of motion between the lock cylinder and a driver mechanism of the hardware. The driver mechanism generally is that mechanism driven upon turning of a key, to unlock the portion of the hardware which prevents the doorknob and spindle from rotating and/or retraction of latch bolt. A tail piece member provides for translation of motion from the key, and lock cylinder, to the driver mechanism.

Through the provision of a tail piece and appropriate mounting adaptors, a lock cylinder arrangement used in a universal knob according to the present invention may also be universal in nature. That is, a special lock cylinder need not be manufactured for each system, since a relatively inexpensive tail piece member can be used to provide adaptation to a variety of systems. This facilitates application of the invention, since a variety of lock cylinders may be used with a variety of hardware systems.

The second type of doorknob or door handle is the male type. Generally for such arrangements the knob includes an extending cylindrical member thereon which fits over the spindle arrangement of the hardware, often engaging same by means of a spring-loaded detent system or the like. Examples of such arrangements are: the Arrow model 551, Arrow Lock Corporation, Brooklyn, N.Y. 11236; Best 5K, 57K and 77K systems, Best Lock Corporation, Indianapolis, Ind. 46250; Dominion 300 Series Locks, Dominion Lock, Division of ILCO Unican Inc., Montreal, Quebec, Canada; LM 300 Series Heavy Duty cylindrical locks, Lloyd Matheson, Inc., Charlestown, N.H. 03603; Schlage A Series locks, Schlage Lock Company, San Francisco, Calif. 94119; and Yale 5500 Series heavy duty cylindrical lock sets, Yale Security Division, Scoville, Inc., Charlotte, N.C. 38212.

The preferred universal handle or knob according to the present invention is of a female design. Adaptation of the present method to a system wherein the key operated knob/handle to be replaced is of a male design, such as those listed above, requires the provision of a mounting adaptor for mounting of the universal knob. The adaptor generally comprises a cylindrical member sized for receipt over, and engagement with, the spindle system of the particular hardware arrangement involved. The preferred adaptor includes a flange thereon, comprising a mounting adapted for mounting of the universal knob. In this manner the universal knob according to the present invention is used to translate motion through to a spindle arrangement of a conventional hardware system which, prior to modification, used a male-type outer knob. The adaptor system, which uses adaptors that may be relatively inexpensive to manufacture by comparison to the universal knob, permits one style of universal knob to be used on virtually any design of lock set.

As with conversions of knob sets having a female-type outer knob, application of the present invention to knob sets having male-type outer knobs generally requires the provision of a tail piece or tail piece member, to provide translation of motion from a lock cylinder arrangement in the universal knob through to a driver mechanism of the hardware system. The tail piece will vary in configuration, depending upon the conventional hardware system being converted.

Universal knobs or handles according to the present invention may be of a variety of designs and shapes, both for ornamental and for utilitarian reasons. A variety of lock cylinder arrangements may be utilized in association with the universal knob of the present invention. For example, lock cylinder arrangements such as 10, 20, 32 series cylinders manufactured by Medeco Security Locks, Inc. of Salem, Va. 24153 or Falcon Interchangeable Cores, from Falcon Lock, Division of Norris Industries, Huntington Beach, Calif. 92649 may be used. A particular advantage to the present invention is that a universal knob may be provided which is adapted for the use with a mortise or rim cylinder arrangement therewith; such cylinders being available in virtually any key way or style desired but in the past generally only usable with mortise or rim lock systems.

The drawings constitute a part of this specification and include exemplary embodiments of the present invention, while illustrating various objects and features thereof. In some instances material thicknesses and relative component sizes may be shown exaggerated, to facilitate an understanding of the invention.

BRIEF DESCRIPTION OF THE DRAWINGS

FIG. 1 is a fragmentary perspective view of a door having a lock assembly which has been converted according to the present invention.

FIG. 2 is an enlarged, exploded, perspective view of a universal doorknob according to the present invention, shown with an interchangeable lock cylinder and with portions broken away to show internal detail.

FIG. 3 is an enlarged, exploded, fragmentary, perspective view of a converted knob lock arrangement wherein the arrangement prior to conversion utilized a female-type outer doorknob.

FIG. 4 is an enlarged, exploded, perspective view of a spindle and adaptor arrangement for a hardware assembly according to an alternate converted arrangement; phantom lines indicating a portion of the arrangement prior to conversion.

FIG. 5 is an exploded, fragmentary top plan view of a portion of a conventional knob lock set utilizing an outer handle of the male-type.

FIG. 6 is an enlarged, fragmentary, exploded perspective view of a knob set according to FIG. 5 converted according to the present invention, phantom lines indicating a portion removed during conversion.

DETAILED DESCRIPTION OF THE PREFERRED AND ALTERNATE EMBODIMENTS

Figure 7:
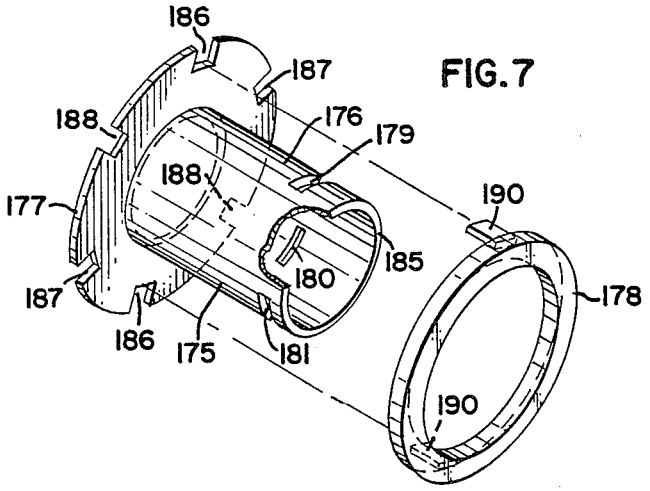
FIG. 7 is an enlarged, exploded, perspective view of an adaptor according to the present invention, with portions broken away to show internal detail.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but rather as a basis for the claims and as a representative basis for teaching one skilled in the art to variously employ the present invention in virtually any appropriately detailed structure.

The reference numeral 1, FIG. 1, generally designates a door and knob or handle system. The system 1 comprises a conventional door 5 having a lock set 6 herein. By the term "lock set" it is meant that the hardware system is such that it can be locked, to prevent opening of the door 5.

The lock set 6 depicted comprises a outside knob 10, with the remainder of the hardware system 11 including an inside knob 12, a latch bolt 13 and an internal lock and spindle mechanism, not shown. As used herein generally the term "hardware system" will be used to refer to all portions of the lock set not including the outer handle, as it is the outer handle or outside knob which is typically replaced according to the present invention. The term "outside knob" refers to that knob which carries a lock core and is replaced according to the present invention with a universal knob. Typically, the outside knob is on the side of a closed door which is outside of a room or building secured by the knob lock set. Detail will not be given for the hardware system 11, since, as will be understood from the following descriptions, the hardware system may be varied considerably in accordance with the principles of the present invention. That is, it is a goal of the present invention to provide a universal knob arrangement that can be utilized with many different makes, manufactures or designs of hardware systems.

Referring again to FIG. 1, the outside knob 10 is generally selectively rotatable to retract latch bolt 13, permitting the door to be opened. For a typical hardware system 11, doorknob 10 is mounted upon a spindle mechanism, not detailed in FIG. 1. The spindle mechanism provides for translation of motion from knob 10 to an appropriate mechanism, such as a cam mechanism, to selectively retract the bolt 13.

When a doorknob lock set such as set 6 is locked, the outer doorknob 10 is prevented from rotation. This may be accomplished by a variety of mechanisms, not detailed. Generally, the hardware system 11 includes internal components which can be selectively operated to prevent the knob 10 and spindle arrangement from rotation. In many systems locking of the door in this fashion is accomplished by means of an internal button 17, FIG. 1. In most such conventional systems when the button 17 is depressed, or rotated, an internal mechanism, not detailed, of the hardware system 11 prevents the spindle and outer knob 10 from rotation. This prevents operation, from outside the door, to retract the latch bolt 13. Thus, the door can be locked closed.

Referring to FIG. 1, in general lock sets, such as lockset 6, whether or not modified according to the present invention, include a lock cylinder arrangement 20 therein. These may be of a variety of designs, some of which are readily interchangeable and others of which are not.

The lock cylinder arrangement 20 shown in FIG. 1, is an interchangeable lock cylinder 21. The cylinder 21 includes a key slot 22. In typical systems utilizing such cylinder arrangements 20, if an appropriate key is placed in slot 22 a portion of the arrangement 20 can be rotated. In many conventional systems, the rotatable portion of the lock cylinder arrangement 20 includes an extension mounted on the inside thereof, which engages a driver mechanism, not shown, in the hardware assembly 11. As a result of the extension and driver mechanism, rotational motion of a key is translated into movement of portions of the hardware mechanism 11, to unlock the system and/or retract latch bolt. That is, rotation of the key generally generates realignment of mechanical parts such that blockage to rotation of the knob 10 and associated spindle is removed. As a result, rotation of the key selectively unlocks the door: permitting the knob 10 to be rotated to retract the latch bolt 13; or, directly retracting the latch bolt without rotating the knob.

A wide variety of manufactures and designs of lock sets are known. Generally, the lock cylinder arrangement 20 of each manufacturer of lock set is specifically designed for a particular manufacturer. That is, the knob is not readily adaptable for mounting on a variety of systems. In many instances this results from the method by which the arrangement 20 is mounted in the outer knob 10. Also, in many instances it results from whatever extension is mounted on an inside portion of the lock cylinder arrangement, for engaging that lock set's driver mechanism.

Two interrelated types of problems occur:

First, the lock set may be of the type not utilizing a readily interchangeable cylinder. For such a system, re-keying of the lock can be a relatively difficult and expensive proposition. For instance, it may require complete disassembly of the hardware and, in some instances, it may require complete replacement thereof. This often requires the services of a locksmith.

In other conventional systems, the outside knob 10 is of a design permitting ready replacement of an interchangeable cylinder. However, even in these systems problems have resulted. Generally, the outer knob and interchangeable lock cylinder are specially developed or designed for the specific manufacture, make or design of hardware involved. Thus, when lock cylinders are changed, they must typically be changed to arrangements of the same or similar manufacture or design. This inhibits improvement, as better cylinders are developed. Further, it can be a problem should the supply of interchangeable cylinders be cut off, as for example through closing of the supplying business or manufacturer. Also, an owner of a facility on a single key system may wish to add another facility to the system. This might require a complete replacement of hardware in one of the two facilities, unless conversion were readily available.

According to the present invention, a method or methodology is provided by which any of a variety of manufactures of conventional lock sets can be provided with a universal knob. Also, according to the invention such systems can be converted, by means of the universal knob, to a system having a selected cylinder style. Further, according to the method, conversion from one cylinder design to another can be readily accomplished.

Referring to FIGS. 1 and 2, the outside knob 10 of doorknob lock set 6, depicted, is a universal knob 25 according to the present invention. Knob 25 is generally circular or global in configuration, however, a variety of designs may be utilized. For example, any of a number of decorative knob designs can be adapted to a system according to the present invention and further non-round knobs, such as levers and the like, can be used. The universal knob 25 includes an inner edge or surface 26, which faces the door 5, and an outer edge or surface 27, which faces away from the door 5.

According to the present invention a universal knob 25 is of such a design and manufacture that it can be readily mounted on or in association with a wide variety of hardware systems 11. Further, a universal knob 25 is generally specifically adapted to accommodate a particular design or manufacture of lock cylinder. Thus, according to the present invention a set of universal knobs can be provided which would enable selection of almost any lock cylinder arrangement for placement in an association with almost any key-in-knob or key-in-handle hardware system.

Universal knob 25, FIGS. 1 and 2, is adapted for mounting of interchangeable cylinder 21 therein. The interchangeable cylinder 21 depicted is generally a figure 8 type cylinder, such as that manufactured by Medeco Security Locks, Inc. of Salem, Va. 24153. However, it will be understood that a variety of systems may be utilized.

Figure 8:
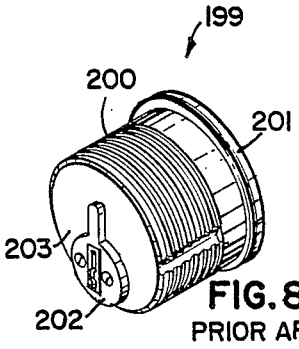
FIG. 8 PRIOR ART
FIG. 8 is a perspective view of a conventional mortise cylinder.

A figure 8 type interchangeable cylinder such as cylinder 21 generally includes a first chamber 30 and a second chamber 31. The second chamber 31 includes a rotatable cylinder 32 therein, operable by means of a key inserted in key slot 22. The first chamber 30 includes a mechanism such as a spring-loaded tumbler mechanism or the like, with retractable members to prevent rotation of cylinder 32 except upon operation with an appropriate key.

Preferably figure 8 type interchangeable cylinders are mounted, as shown, with the first chamber 30 positioned above the second chamber 31. In this preferred arrangement, spring-loaded detents or tumblers which are used to prevent rotation and cylinder 32 except upon operation by an appropriate key are biased into position for locking both by operation of internal springs, not shown, and gravity. As a result, increased security is obtained.

As previously indicated, interchangeable cylinder 21 is such that it can be readily mounted or dismounted in knob 10. For the preferred arrangement depicted in FIGS. 1 and 2, interchangeable cylinder 21 is such that it can be removed from outside universal knob 25, without dismounting the knob 25 from the doorknob lock set 6. Referring to FIG. 2, interchangeable cylinder 21 includes an extension 35 thereon. The extension 35 is receivable within a recess inside of knob 25, not shown. Extension 35 is selectively extendable and retractable from within interchangeable cylinder 21. Extension or retraction of member 35 is accomplished by means of a control key that can be fitted within key slot 22. With the control key an operator can selectively retract extension 35, such retraction permitting cylinder 21 to be readily removed from, or inserted in, knob 25. Generally, interchangeable cylinders 21 are designed such that keys such as master keys and individual keys, which can rotate cylinder 32 to unlock the doors, are not designed to operate extension and/or retraction of member 35. Thus, an authorized person can have access to a room or the like by means of a key operable to permit unlocking of the door, without having the ability to remove the lock core. Generally, the control key is maintained by building security, management or the locksmith.

As previously explained, generally hardware sets are of two basic types, those in which the outer knob is of a female-type and those in which the outer knob is of a male-type. Female-type outer knobs include a substantial recess along an inner edge thereof, in which a portion of the spindle arrangement is received. Male type sets, on the other hand, include an extension projecting outwardly from the outward knob, and toward the door. These extensions are generally sized to engage, typically through overlapping, a spindle mechanism for mounting in the doorknob lock set. According to he present invention either of these types of doorknob lock sets is readily converted to a universal knob.

The universal knob 25, FIG. 2, according to the preferred embodiment of the present invention is preferably of the female-type and includes a bore 40 in an inner edge 26 thereof. The bore 40 has an inner surface 42. The inner surface 42 includes a channel 43 therethrough. Channel 43 provides for communication between part of the assembly described below with respect to FIG. 3 and a lock cylinder arrangement utilized in association with knob 25.

FIG. 3 illustrates a conventional doorknob lock set converted to utilization of a universal knob 25. The doorknob lock set of FIG. 3 is a set 50 for which the outer knob, not shown, that was originally provided with the assembly was of the female-type. The set 50 depicted in FIG. 3 is generally analogous to one of manufacture by P & F Corbin, Hardware Division, Emhart Industries, Inc., Berlin, Conn. 06037. However, it will be understood that the universal knob of the present invention may be utilized with a variety of similar systems.

Referring to FIG. 3, set 50 comprises a hardware set 51 mounted in a door 52. Much of the internal hardware is out of view in FIG. 3 and its detail is well understood and is not specifically related to the principles of the present invention. Set 51 includes a spindle 55 on which the outer knob i mounted. Spindle 55, by means of internal mechanism not detailed, generates by its rotation retraction of an associated latch bolt to open the door 52. Spindle 55, similar to a typical Corbin design, includes an outer end 56 having a mounting flange 57 thereon. The mounting flange 57 includes a pair of outwardly extending ears or tangs 58. The preferred ears 58 are positioned 180° apart, for reasons which will be understood by the following.

A universal knob 25 according to the present invention includes a pair of recesses 60 within the inner surface 42 and oriented for receipt of ears 58. When knob 25 is mounted, flange 57 is received within bore 40, rotational orientation being accomplished by, and secure engagement being accomplished by, insertion of ears 58 into recesses 60. Snap ring 61 can be received within bore 40 to maintain secure engagement for the arrangement depicted, FIG. 3, a washer 62 is also used. Referring to FIG. 2, the preferred bore 40 includes an annular recess 63 therein into which snap ring 61 can be received. It will be understood that a variety of securing arrangements other than a snap ring can be used.

Because preferred recesses 60 and ears 58 are positioned 180° apart, knob 25 can be rotated 180° to either of two positions at mounting. In this manner both right-hand and left-hand knob lock systems can be accommodated by knob 25, with the knob 25 always being oriented with lock cylinder 30 above cylinder 31.

Preferably recess 40 is sufficiently deep so that the internal surface 26 of knob 25 is positioned sufficiently close to a portion 65 of hardware set 51 so that a tool or the like cannot be readily inserted up the bore 40 to contract snap ring 61 and remove the knob 25 from the door. In some systems it may be desireable to mount a pin, screw, cover plate or the like in association with snap ring 61, the pin being oriented to prevent collapsing or contraction of the snap ring 61. In this manner, removal of knob 25 from the spindle 55 can be prevented.

Generally, hardware systems of the conventional type are manufactured such that key operated knobs cannot be readily removed except by those possessing the proper tools, skills and most often the proper key. Applicants' universal knob 25 is appropriate for such systems, as previously described.

Referring to FIG. 3, the hardware set 51 includes driver 66 therein. Driver 66 is generally received within spindle 55 and, upon rotation, operates internal portions of the mechanism, not detailed, to selectively unlock the mechanism or permit retraction of the latch bolt. Rotation of the driver 66, for a conventional Corbin system prior to modification according to the present invention, was accomplished by means of a member extending outwardly from an end of a Corbin lock cylinder.

According to the present invention, an interchangeable cylinder 21 is provided. This cylinder is usable in a universal knob 25 virtually regardless of what design of lock system is involved. Therefore, the lock cylinder 21 does not include special extension mounted on the end thereof which engages driver 66.

According to the present invention, an interchangeable cylinder 21 is provided which has a unique end thereon. A tail piece or tail piece member is provided according to the present invention to permit translation of motion from the interchangeable cylinder to a selected drive mechanism for the particular lock set involved. This will be readily understood by reference to FIGS. 2 and 3 as follows:

Referring to FIG. 2, rotatable cylinder 32 includes an inner end 70 which faces the door 52 during use. Thus, by comparison to a lock cylinder which would be conventionally utilized in association with a hardware system such as that illustrated in FIG. 3, end 70 is truncated. That is, it does not include an extension capable of translating motion to driver 66. Again, a reason for this is that cylinder 21 is specifically adapted for use in association with the universal knob 25 which might be mounted on almost any hardware mechanism, including ones which have substantially different driver mechanisms from driver 66.

According to the present invention, whenever universal knob 25 is mounted in association with a hardware system, a tail piece or tail piece member is provided. That tail piece or tail piece member is specifically adapted to translate motion between the lock cylinder 21, located within universal knob 25, and the driver mechanism of the hardware system being converted. Referring to FIG. 3, the tail piece member for the particular system illustrated is designated by reference numeral 74. Tail piece 74 comprises a cylindrical unit or cylinder having a first end 75 and a second end 76. First end 75 generally faces outwardly from the door. The first end 75 includes engagement means thereon for engagement with rotatable cylinder 32. The second end 76 includes engagement means thereon for engagement with the driver 66 of the hardware system being converted. The particular design of first and second ends of tail piece members will typically be dictated by the nature of the lock cylinder involved and the driver mechanism involved.

End 70 of rotatable cylinder 32 includes a pair of slots 80 therein. As will be understood from FIG. 3, slots 80 comprise a portion of an engagement mechanism for engaging an associated tail piece 74. The tail piece 74 includes ridges 81 on first end 75. The ridges 81 are sized such as to be receivable within slots 80, thus providing for engagement between lock cylinder 21 and tail piece 74. As a result, as cylinder 32 is rotated by the key, tail piece member 74 is also rotated. Generally, slots 80 and ridges 81 comprise a tongue and groove engagement mechanism. A first member of such a mechanism may be positioned on either of the cylinder 32 or the tail piece 74, with the corresponding engagement member positioned on the corresponding place of hardware.

For the particular hardware system depicted in FIG. 3, driver 66 includes a first end 85 having a pair of ridges 86 thereon. It will be apparent from examination of FIG. 3 that a tail piece member adapted to engage driver 66 would, preferably, include a slot 90 as an engagement mechanism or member in end 76. Generally, ridges 86 and slot 90 comprise a tongue and groove engagement mechanism. It will be understood that the driver 66 may include either member of the tongue and groove system, with the tail piece including a corresponding member.

Again, from the above description it will be readily understood that the design of the tail piece 74 will generally be dictated by the particular hardware system on which universal knob is being mounted, and also by the particular design of lock core 21 utilized with that particular universal knob 25. Thus, it will be understood that tail piece member 74 merely provides an example of an arrangement according to the present invention.

In sum, examinations of FIGS. 1, 2 and 3 leads to an understanding of conversion of a particular style or type of hardware system to one having a universal knob according to the present invention. Universal knob 25 is designed for ready mounting or dismounting of a particular manufacture of core 21. The hardware system 50 is of a type specifically adapted for use with an outer knob and lock assembly of the same manufacture as the remainder of the hardware. According to the present invention, the original key operated knob is removed and replaced with the present universal knob, mounted as shown for the particular example shown. A tail piece member is also provided, to permit engagement between the universal knob, through the selected lock cylinder, and the driver mechanism for the converted hardware.

It will be understood by those skilled in the art that the spindle designs of many arrangements are not as shown in FIG. 3. To accommodate this, the universal knob 25 according to the present invention is utilized in association with mounting means or adaptors, permitting mounting on a variety of systems. An example is illustrated by FIG. 4.

Referring to FIG. 4, a spindle 100 and driver 101 of an alternate hardware system are depicted. The particular designs after which the illustration of FIG. 4 is patterned are the Sargent Model 2U05, 2G05, 2G63 systems, Sargent & Company, New Haven, Conn. For such a system a female knob, not shown, is generally threaded upon threads 105 oriented on a flange portion 106 of the spindle 100. The particular Sargent system after which spindle 100 is patterned included an extension 107 projecting outwardly beyond flange 106.

A preferred universal knob 25 according to the present invention does not include threads therein. Conversion of a system, such as that illustrated in FIG. 4, requires provision of a mounting adaptor 110. Adaptor 110 includes a central aperture 111 with threads therein for engagement with threads 105. Adaptor 110 also includes an outer surface 112, with ears 113 thereon oriented for engagement with recesses 60, FIG. 2, in the universal knob 25.

In some instances the existing conventional spindle 100 may need to be modified, for mounting of an adaptor and universal knob 25 according to the present invention. An example of this is illustrated in FIG. 4, wherein portion 107 has been cut off of spindle 100. As a result of this adaptor 110 and universal knob 25 are readily accepted.

In FIG. 4, the driver 101 depicted is of a different design and manufacture from that of driver 66, FIG. 3. However, generally its purpose is the same. That is, it translates motion from the rotatable lock cylinder to internal mechanisms, not depicted, which unlocks whatever mechanism prevents rotation of the spindle 100 or retracts the latch bolt. In FIG. 4, a tail piece 115 is depicted for use in association with a spindle 100 that has been converted for mounting a universal knob 25 according to the present invention. Tail piece 115 includes a first end 116 having ridges 117 thereon for engagement with a rotatable cylinder such as cylinder 32, FIG. 2. Tail piece 115 includes a second end 118 having outwardly projecting posts 119 thereon oriented for engagement with driver 101. For the particular driver 101 depicted, engagement occurs by means of extension of posts 119 through slots 120. The particular tail piece 115 depicted in FIG. 4 is longer than tail piece 66 of FIG. 3, due to the nature of the design of the conventional hardware system illustrated being converted in FIG. 4. For the arrangements described and shown, mounting of universal knob 25 has been by means of recesses 60 and flange ears 58. This arrangement is often preferred as it is convenient and relatively inexpensive to provide. However, it will be understood that alternate mounting means may be used.

From the above descriptions of FIGS. 1–4, it will be readily understood how almost any conventional utilizing a female-type key operated knob can be adapted and modified to a universal knob arrangement, according to the present invention. Generally, a universal knob according to the principles of the invention is provided, with a lock cylinder in association therewith. A tail piece member is provided for the particular system being converted; the tail piece having a first end adapted for engagement with a lock cylinder and rotation thereby, and a second end adapted for engagement with a driver mechanism of the hardware system being converted. In most systems, a mounting adaptor must be provided, so that the universal knob can be mounted. In a system such as that illustrated in FIG. 4, an existing spindle 100 is modified, by removal of portion 107, to accommodate mounting of universal knob 25. It will be understood that in general any of these modifications can be relatively and inexpensively accomplished. As a result, a system can be converted to one having a relatively expensive, heavy duty, key-operated knob 25 and if desired a relatively expensive interchangeable lock core, at perhaps the same cost as former complete replacement or relatively inexpensive hardware.

As previously indicated, the principles of the present invention can be applied to knob and lock set arrangements wherein the knob is of the male type. An example of this is presented by FIGS. 5 and 6. The conventional system of FIG. 5 comprises a door 130, an outer knob 131 and a hardware system 132. Hardware system 132 includes a spindle member 133 projecting outwardly therefrom. Knob 131 includes an extension 134 projecting toward the door 130. Outer knobs characterized by an extension such as, or analagous to, extension 134 are referred to herein as male-type knobs. For the particular arrangement illustrated in FIG. 5, extension 134 is of a greater diameter than spindle 133 and fits therearound, receiving the spindle 133 therein during assembly. However, constructions in which the extension 134 fits inside of the spindle 133 are possible and would be handled in an analogous manner. During assembly a spring-loaded retainer arrangement including retainer 135 mounted in association with spindle 33 engages a slot arrangement comprising receiving space 137 in extension 134. In this manner, a secure engagement between the knob 131 and the spindle 133 is provided.

Generally, arrangements such as that illustrated in FIG. 5 are such that retainer 135 cannot be depressed to release knob 131 from its mount, without special tools, equipment, keys, access to the inside of the door, or combinations thereof. A variety of designs of such male-type systems are well-known, the example of FIG. 5 generally illustrating one similar to the 5500 series heavy duty cylindrical lock sets of the Yale Security Division of Scoville, Inc., Charlotte, N.C. 28212.

It will be understood that hardware system 132, FIG. 5, includes a driver mechanism, not shown, engageable by means of a conventional lock cylinder arrangement, not depicted, oriented in knob 131. Generally, as for the conventional system depicted in FIG. 3, prior to conversion the driver mechanism includes a member engageable by a portion of a custom conventional cylinder arrangement specially designed for mounting in knob 131.

Application of the present invention to an arrangement such as that illustrated in FIG. 5 will be understood by reference to FIG. 6.

According to the present invention, a mounting adaptor 145 is provided by means of which a universal D knob can be mounted upon a spindle 133 of a male-type system. The particular adaptor 145 of FIG. 6 includes a cylindrical portion 146 and an outer flange portion 147. The outer flange portion 147 is sized for receipt within bore 40 of a universal knob 25, FIG. 2. Flange 147 includes ears 148 thereon, to provide secure engagement with knob 25 through means of recesses 60. Adaptor 145 can be readily mounted in association with a knob 25 by a variety of means, including a snap ring arrangement such as that illustrated in FIG. 3.

Cylinder 145 is sized to be received around spindle 133, in a manner analogous to that for extension 34, FIG. 5. Cylinder portion 146 includes slot means 48 therein, for engagement with retainer 135.

In some arrangements the existing spindle may be short enough to permit an adaptor 145 and universal knob 25 to be mounted thereon without further modification. Such is not the case, however, for the example specifically illustrated by FIGS. 5 and 6 wherein the spindle 133 is sufficiently long to obstruct mounting of universal knob 25. Conversion according to the present invention for such a system generally involves removal of a portion 150, FIG. 6, of the spindle 133. This may be accomplished relatively rapidly and inexpensively by use of a power saw or the like.

As in the previously described systems, a tail piece 152 typically must be provided to translate motion from a selected lock cylinder to the specific driver mechanism of the particular lock set being converted. The system illustrated in FIG. 6 utilizes a driver mechanism including a receiving slot 153. Tail piece 152 includes a first end 160 and a second end 161. The first end 160 includes a pair of ridges 162 thereon for engagement with an end of a rotating cylinder in a lock arrangement such as that illustrated in FIG. 2. The second end 161 includes an elongate extension 163 thereon sized for engagement with slot 153 in the driver mechanism, not detailed for the preferred embodiment of FIG. 6 spindle 133 has two slots 165 thereon oriented for engagement by tabs 166 on member 145. This provides for a preferred, secure arrangement.

From the above description it will be apparent that the method of converting a male-type knob lock set to one utilizing a universal knob according to the present invention generally comprises: provision of an appropriate knob mounting adaptor member for the existing hardware; provision of an appropriate tail piece member; and selection of the universal knob and desired lock cylinder. If necessary, the existing portion of the spindle member of the hardware mechanism being converted can be shortened, for mounting of the adaptor thereon.

In FIG. 7, an alternate type of adaptor for utilization in male-type systems is illustrated. The adaptor 175 of FIG. 7 includes a cylinder portion 176, a flange 177 and a separable ring member 178.

Adaptor 175 is designed such that it can be utilized with a variety of spindle systems, having retainer slots or various methods of mounting, located in different places. The particular adaptor 175 depicted is arranged for mounting in association with three different designs of spindle arrangements. In particular, cylinder portion 176 includes three slots 179, 180 and 181 therein. Each of slots 179, 180 and 181 is of a different size and is spaced a different distance from end 185 of the adaptor 175.

For the preferred embodiment illustrated in FIG. 7, the adaptor 175 has retainer slots 179, 180 and 181 positioned spaced about 120°, radially, apart from one another around cylindrical portion 176. The flange 177 includes pairs of spaces comprising notches 186, 187 and 188. Each pair of notches is appropriately aligned with respect to a retainer slot, so that when the adaptor 175 is mounted upon a particular spindle arrangement by means of that retainer slot, an associated pair of notches is aligned appropriately for mounting an adaptor member 25 in a preferred orientation for example with the lock cylinder, of a figure eight type design, positioned with its non-rotatable cylinder above its rotatable cylinder.

Mounting of the adaptor member 25 is accomplished by means of ears 190 on ring member 178. Ring member 178 can be rotationally oriented to engage any of a selected pair of the sets of notches 186, 187 or 188. For the preferred embodiment of FIG. 7, ring 178 is rotated between pairs of sets of notches, by 120° rotation. Ring 178 is shown oriented for engagement between ears 190 and notches 186.

Operation of an adaptor member 175 according to FIG. 7, will be readily understood by examination of FIG. 7 in comparison with FIG. 6. The adaptor member 175 can be mounted upon a selected spindle, by appropriate engagement of one of the slots 179, 180 and 181 with a retainer in the spindle. The appropriate retainer slot would be chosen, for use with that particular spindle. The ring 178 would then be rotationally oriented with an appropriate set of the notches, so that a knob 25 can be readily mounted upon ears 190. Secure engagement can be accommodated by means of a snap ring arrangement, such as that illustrated in FIG. 3.

As a result of the above arrangement, an adaptor such as adaptor 175 of FIG. 7 can mount a universal knob such as knob 25 upon any of a plurality of different spindle arrangements. It will be understood that a variety of adaptors, including means for mounting on almost any number or design of spindle arrangements can be developed according to the principles described herein.

As previously discussed a variety of lock cylinders may be utilized in association with universal knobs according to the present invention. For the examples illustrated in FIGS. 1–6, cylinder 21 of FIG. 2 is used. However, a different universal knob 25 could be developed for a different designs of lock cylinders with only minor modifications. Generally, these modifications would relate to the shape of the receiving aperture or mounting means in knob 25 for receipt of the lock cylinders. Thus, non-interchangeable core cylinders, or internally mounted cores removable from the inner surface 26 of the knob, could be readily accommodated. It will be understood that should the varying lock cylinders have different types of inner ends on the rotatable cylinder, different sets of tail pieces could be adapted for use with that particular system in converting lock arrangements of various manufactures.

It is an advantage of the present invention that the universal knob can even be adapted for use in association with mortise or rim cylinder arrangements. Knob sets have not been provided for use in association with such arrangements. Rather, mortise cylinders and rim cylinders have been exclusively used in mortise or rim lock arrangements, rather than knob set arrangements.

A conventional mortise cylinder 199 is depicted in FIG. 8. The cylinder includes a threaded outer surface 200. A lock core is positioned within the arrangement. Cam 202 is mounted, rotatably, on an inner end 203 of the mortise cylinder 199. The cam 202 is readily rotated by turning a key in the cylinder, to operate a conventional mortise lock mechanism.

According to the present invention, the mortise cylinder 199 is readily converted for use in a universal knob arrangement. This is readily understood by reference to FIG. 9, wherein the mortise cylinder 206 has been converted by removal of cam 202 and replacement with a rotatable member 204 having means therein for engagement with a rotatable tail piece member. The particular means of member 204 is a ridge 208, although in some arrangements other means such as a trough may be used.

Figure 9:
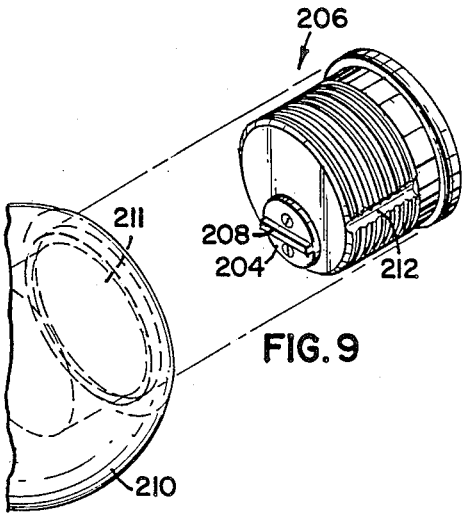
FIG. 9 is a fragmentary, exploded, perspective view of a universal knob according to the present invention in association with a converted mortise cylinder; phantom lines indicating portions out-of-view.

Referring to FIG. 9, reference numeral 210 generally designates a universal knob adapted for mounting of converted mortise cylinder member 206. Convenient mounting is provided by means of an internal chamber 211 including a counterbore portion and a threaded portion. Pins, not shown, may be associated with slots such as side slot 212 to prevent rotation of the mortise cylinder 206 and inhibit unauthorized removal from the knob 210.

Figure 10:
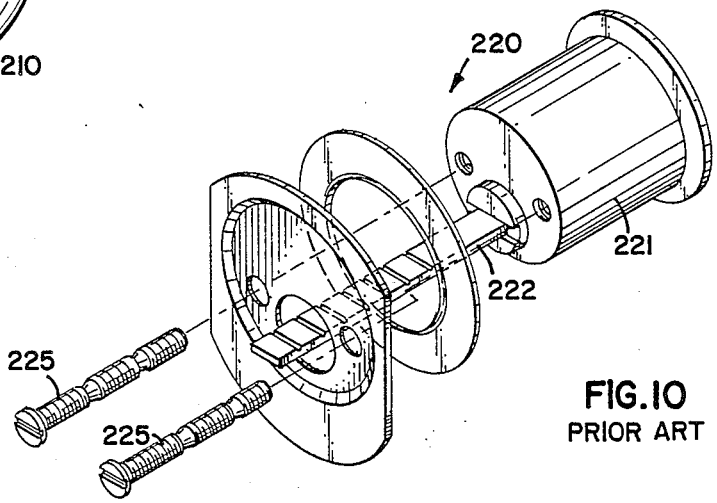
FIG. 10 PRIOR ART
FIG. 10 is an exploded, perspective view of a conventional rim lock cylinder, adaptable according to the present invention for utilization in association with a universal knob.

The present invention may also be utilized in association with a rim cylinder arrangement. In FIG. 10 a conventional rim cylinder and mounting arrangement 220 is illustrated. The arrangement includes a cylinder lock 221 including an elongate extension 222 thereon. Removal or shortening of the extension 222 and adaption of the cylinder to include an engagement mechanism for a tail piece, leads to an arrangement which can be readily mounted within a universal knob according to the present invention. Generally, mounting of a rim cylinder such as cylinder 221 in a conventional rim lock arrangement is accomplished by means of bolts 225 or the like from the inside of a door. It will be readily understood to those of skill in the art that a similar bolt mounting arrangement can be provided in a universal knob according to the present invention.

EXAMPLES

The following examples illustrate application of the present invention to modify several different types of conventional lock sets. For each of the examples described, a universal knob arrangement such as that illustrated in FIG. 2 is provided, utilizing an interchangeable lock core such as that depicted, an example being on manufactured by Medeco.

EXAMPLE 1

The owners of an office building having an assortment of 50 medium and heavy duty lock sets therein, each of which is a Corbin No. 351 Entrance and Office Lock, wish to convert to a Medeco interchangeable core cylinder, without complete replacement of all hardware. Fifty universal knobs, each designed for mounting of a Medeco interchangeable core cylinder therein are provided. The key operated handle of each Corbin knob is dismounted. Since a Corbin spindle for such a lock includes a flange and ears thereon appropriately oriented for engagement with the universal knob, no mounting adaptor is necessary. A tail piece member, analagous to member 74, FIG. 3, is provided for each arrangement. The tail piece member is inserted into the spindle, for engagement with the driver. The universal knob is then mounted on the spindle flange.

Each system has, by these operations, been converted to a universal knob having a Medeco interchangeable core cylinder without replacement of the entire hardware system.

EXAMPLE 2

A school board wishes to convert a school building having 100 Sargent Model 2U05 key in knob lock therein to interchangeable core Medeco cylinders. The outer knob of each assembly is removed, to achieve dismounting from the threaded spindle.

Referring to FIG. 4, each spindle member is shortened, by removal of portion 107. An adaptor member is threaded onto the spindle, for receiving the universal knob. One hundred tail piece members are provided, each suitable for translating motion from the Medeco interchangeable core cylinder to the driver of the Sargent lock mechanism. One tail piece member is mounted in each set of hardware. A universal knob, in association with the Medeco interchangeable core cylinder, is mounted on each knob set.

As a result of the above steps, conversion will have occurred without the need for replacement of the full hardware of each and every one of the 100 locks.

EXAMPLE 3

The owner of an apartment complex having 40 units each of which has a doorknob manufactured by Schlage Lock Company, of San Francisco, Calif. 94119, wishes to convert each lock assembly to one having interchangeable core Medeco cylinders. The outer, male, knob of each assembly is removed. The spindle of each assembly is shortened, for receipt of an adaptor member according to the present invention, as illustrated in FIG. 6. Forty tail piece members such as those of FIG. 6 are provided, one per lock. A universal knob, in association with a Medeco interchangeable core cylinder, is mounted on each lock.

As a result of the above-described steps, conversion has occurred without the need for replacement of most of the hardware materials already in place.

It will be readily understood to those of ordinary skill in the art that tail piece members according to the present invention and universal knobs according to the present invention can be relatively inexpensively manufactured. Further, conversion of each system can be relatively readily accomplished, keeping labor costs to a minimum. Thus, as a result of the present invention, conversion to a high quality, relatively in interchangeable core locks can be accomplished in systems wherein such a conversion might otherwise have been unfeasible because of cost. That is, prior to the present invention, generally complete replacement of all hardware would have been necessary to accomplish such a conversion or custom handles would have been required. According to the present invention, most hardware already in place can be retained, thus saving considerable expense in both parts and labor; money which can be directed toward obtaining a higher quality lock cylinder if desired.

It is to be understood that while certain embodiments of the present invention have been illustrated and described, the invention is not to be limited to the specific forms or arrangement of parts herein described and shown.

What is claimed and desired to be secured as Letters Patent is as follows:

1. A method of converting a lock set having a first lock cylinder to one having a different alternate lock cylinder therein; said method including the steps of:

(a) providing a lock set having a first lock cylinder, a spindle, and a driver mechanism to be converted; and, removing the first lock cylinder therefrom;

(b) providing a universal knob for mounting on a variety of lock sets of a variety of designs; said universal knob having an outer edge portion, an inner edge portion and an internal bore;

(i) said bore defining a mounting chamber extending inwardly from said inner edge portion and including mounting means;

(ii) said universal knob including means for operatively mounting a lock cylinder mechanism therein;

(c) providing a lock cylinder mechanism having a rotatable alternate lock cylinder with a first end and a second end;

(i) said rotatable alternate cylinder first end including a key slot therein;

(ii) said rotatable alternate cylinder second end including a tail piece engagement mechanism thereon;

(d) providing a tail piece member selectively engageable by said rotatable alternate lock cylinder second end, to be rotated thereby; said tail piece member including means for selectively engaging and operating a driver mechanism of the lock set to be converted;

(e) providing a spindle adaptor selectively mountable on the lock spindle of the lock set; said spindle adaptor including a mounting flange receivable within said universal knob bore;

(i) said spindle adaptor mounting flange including first and second mounting ears projecting outwardly therefrom;

(ii) said universal knob bore defining an inner mounting face having first and second oppositely positioned mounting recesses therein, said mounting recesses being oriented for receipt of said mounting ears therein;

(f) mounting said spindle adaptor on the spindle of the lock set;

(g) mounting the universal knob on the spindle adaptor with said spindle adaptor ears received within said knob bore mounting recesses; and, (h) mounting said lock cylinder mechanism in said universal knob with said tail piece member in engagement with, and in extension between, said rotatable alternate cylinder and the driver mechanism to transmit rotational motion therebetween.

2. The method according to claim 1 wherein:

(a) the spindle includes a threaded knob mounting lug thereon;

(b) said mounting adaptor includes threaded bore therein; and, (c) the step of mounting said spindle adaptor on the spindle comprises threading said adaptor onto said spindle mounting lug.

3. The method according to claim 2 wherein:

(a) the spindle knob mounting lug includes a non-threaded extension projecting outwardly therefrom; and, (b) said steps of mounting said spindle adaptor and said universal knob include substantially removing said non-threaded extension.

4. The method according to claim 1 wherein:

(a) the spindle comprises an extension having a first outside diameter;

(b) the spindle adaptor includes a cylindrical portion having an interval bore of a second diameter slightly larger than the spindle extension first outside diameter; and (c) said step of mounting said spindle adaptor includes positioning the spindle cylindrically shaped extension within said spindle adaptor internal bore.

5. The method according to claim 4 wherein:

(a) the spindle includes a retainer mounting mechanism thereon; and, (b) said spindle adaptor includes retainer receiving means therein; and (c) wherein said step of mounting said spindle adaptor includes positioning retainer mounting mechanism within said retainer receiving means.

6. The method according to claim 4 wherein said step of mounting said spindle adaptor and said universal knob include shortening the spindle extension.

7. A method of converting a lock set having a first lock cylinder to one having a different alternate lock cylinder therein; said method including the steps of:

(a) providing a lock set having a first lock cylinder, a spindle, and a driver mechanism, to be converted; and, removing the first lock cylinder therefrom;

(b) providing a universal knob for mounting on a variety of lock sets of a variety of designs; said universal knob having an outer edge portion, an inner edge portion and an internal bore;

(i) said bore defining a mounting chamber extending inwardly from said inner edge portion and including mounting means;

(ii) said universal knob including means for operatively mounting a lock cylinder mechanism therein;

(c) providing a lock cylinder mechanism having a rotatable alternate lock cylinder with a first end and a second end;

(i) said rotatable alternate cylinder first end including a key slot therein;

(ii) said rotatable alternate cylinder second end including a tail piece engagement mechanism thereon;

(d) providing a tail piece member selectively engageable by said rotatable alternate cylinder second end, to be rotated thereby; said tail piece member including means for selectively engaging and operating a driver mechanism of the lock set to be converted;

(e) providing a spindle adaptor selectively mountable on the spindle of the lock set; said spindle adaptor including mounting means adapted to mate with mounting means of said inner edge portion of said universal knob for releasably mounting said universal knob in association with a spindle of the lock set to be converted;

(f) mounting said spindle adaptor on the spindle of the lock set;

(g) mounting the universal knob on the spindle adaptor with said spindle adaptor mounting means in mating relationship with said mounting means of said inner edge portion of said universal knob; and, (h) mounting said lock cylinder mechanism in said universal knob with said tail piece member in engagement with, and in extension between, said alternate rotatable cylinder and the driver mechanism to transmit rotational motion therebetween.

8. A method according to claim 7 wherein:

(a) said spindle includes a threaded knob mounting lug thereon;

(b) said mounting adaptor includes a threaded bore therein; and wherein (c) the step of mounting said spindle adaptor on the spindle comprises threading said adaptor onto said spindle mounting lug.

9. The method according to claim 8 wherein:

(a) the spindle knob mounting lug includes a non-threaded extension projecting outwardly therefrom; and (b) wherein said steps of mounting said spindle adaptor and said universal knob include substantially removing said non-threaded extension.

10. The method according to claim 7 wherein:

(a) the spindle comprises an extension having a first outside diameter;

(b) the spindle adaptor includes a cylindrical portion having an internal bore of a second diameter slightly larger than the spindle extension first outside diameter; and (c) wherein said step of mounting said spindle adaptor includes positioning the spindle cylindrically shaped extension within said spindle adaptor internal bore.

11. The method according to claim 10 wherein:

(a) the spindle includes a retainer mounting mechanism thereon; and (b) said spindle adaptor includes a retainer receiving means therein, and (c) wherein said step of mounting said spindle adaptor includes positioning retainer mounting mechanism within said retainer receiving means.

12. The method according to claim 10 wherein said step of mounting said spindle adaptor on said universal knob includes shortening the spindle extension.

13. A method according to claim 7 wherein:

(a) said spindle adaptor mounting means includes a spindle adaptor mounting flange receivable within said universal knob bore; said spindle adaptor mounting flange including first and second mounting ears projecting outwardly therefrom; and (b) said universal knob inner edge portion mounting means includes an inner mounting face defined by said universal knob bore; said inner mounting face having first and oppositely positioned mounting recesses therein, said mounting recesses being oriented for receipt of said mounting ears therein; and (c) wherein said step of mounting said spindle adaptor includes positioning said mounting ears within said mounting recesses.

14. A method of converting a lock set having a first lock cylinder to one having a different alternate lock cylinder therein; said method including the steps of:

(a) providing a lock set having a first lock cylinder, a spindle, and a driver mechanism, to be converted, and removing the first lock cylinder therefrom;

(b) providing a universal knob for mounting on a variety of lock sets of a variety of designs; said universal knob having an outer edge portion, an inner edge portion and cylinder mounting means for operatively mounting a lock cylinder mechanism on said universal knob;

(c) providing a lock cylinder mechanism having a rotatable alternate lock cylinder with a first end and a second end;

(i) said rotatable alternate cylinder first end including a key slot therein;

(ii) said rotatable alternate cylinder second end including a tail piece engagement mechanism thereon;

(d) providing a tail piece member selectively engageable by said rotatable alternate cylinder second end, to be rotated thereby; said tail piece member including means for selectively engaging and operating a driver mechanism of the lock set to be converted;

(e) providing a spindle adaptor selectively mountable on the spindle of the lock set; said spindle adaptor including mounting means adapted to mate with mounting means of said universal knob for releasably mounting said spindle adaptor on said universal knob;

(f) mounting said spindle adaptor on the spindle of the lock set;

(g) mounting the universal knob on the spindle adaptor with said spindle adaptor mounting means in mating relationship with said universal knob mounting means; and, (h) mounting said lock cylinder mechanism in said universal knob with said tail piece member in engagement with, and in extension between, said rotatable alternate cylinder and the driver mechanism, to transmit rotational motion therebetween.

15. A method according to claim 14 wherein:

(a) the spindle includes a threaded knob mounting lug thereon;

(b) said mounting adaptor includes a threaded bore therein; and (c) the step of mounting said spindle adaptor on the spindle comprises threading said adaptor onto said spindle mounting lug.

16. The method according to claim 15 wherein:

(a) the spindle knob mounting lug includes a non-threaded extension projecting outwardly therefrom; and (b) said steps of mounting said spindle adaptor and said universal knob include substantially removing said non-threaded extension.

17. The method according to claim 14 wherein:

(a) the spindle comprises an extension having a first outside diameter;

(b) the spindle adaptor includes a cylindrical portion having an internal bore of a second diameter slightly larger than the spindle extension first outside diameter; and (c) said step of mounting said spindle adaptor includes positioning the spindle cylindrically shaped extension within said spindle adaptor internal bore.

18. The method according to claim 17 wherein:

(a) the spindle includes a retainer mounting mechanism thereon; and (b) said spindle adaptor includes retainer receiving means therein.

19. The method according to claim 17 wherein said step of mounting said spindle adaptor on said universal knob include shortening the spindle extension.

20. A method according to claim 14 wherein:

(a) said spindle adaptor mounting means includes a spindle adaptor mounting flange receivable within said universal knob bore; said spindle adaptor mounting flange including first and second mounting ears projecting outwardly therefrom; and (b) said universal knob inner edge portion mounting means includes an inner mounting face defined by said universal knob bore; said inner mounting face having first and oppositely positioned mounting recesses therein, said mounting recesses being oriented for receipt of said mounting ears therein; and (c) wherein said step of mounting said spindle adaptor includes positioning said mounting ears within said mounting recesses.

21. A method according to claim 14 wherein: said cylinder mounting means includes an internal bore defined by said universal knob.

* * * * *